US009066633B1

(12) United States Patent
Meriwether

(10) Patent No.: US 9,066,633 B1
(45) Date of Patent: Jun. 30, 2015

(54) HYGIENIC WASHING SYSTEM FOR USE WITH A WASHROOM FIXTURE

(76) Inventor: Paul Edwin Meriwether, Montgomery, AL (US)

( * ) Notice: Subject to any disclaimer, the term of this patent is extended or adjusted under 35 U.S.C. 154(b) by 660 days.

(21) Appl. No.: 13/445,804

(22) Filed: Apr. 12, 2012

Related U.S. Application Data

(60) Provisional application No. 61/475,724, filed on Apr. 15, 2011.

(51) Int. Cl.
*A47K 3/022* (2006.01)

(52) U.S. Cl.
CPC ..... *A47K 3/022* (2013.01)

(58) Field of Classification Search
CPC ..... E03D 9/08
USPC ..... 4/443–448
See application file for complete search history.

(56) References Cited

U.S. PATENT DOCUMENTS 4,370,764 A * 2/1983 Ando et al. ..... 4/443
4,422,189 A * 12/1983 Couvrette ..... 4/420.2
4,581,779 A * 4/1986 Matsui et al. ..... 4/420.2
D346,861 S * 5/1994 Martin ..... D24/133
5,359,736 A * 11/1994 Olivier ..... 4/448
5,893,177 A * 4/1999 Roemen et al. ..... 4/443
6,145,154 A * 11/2000 Blair ..... 15/210.1
6,158,077 A * 12/2000 Wenger et al. ..... 15/210.1
D439,977 S * 4/2001 Wenger et al. ..... D24/133
6,272,716 B1 * 8/2001 Thornton ..... 15/210.1
6,618,865 B1 * 9/2003 Kim ..... 4/420.4
6,941,590 B2 * 9/2005 Lim ..... 4/420.4
6,955,662 B2 * 10/2005 Moser et al. ..... 604/279
6,959,459 B2 * 11/2005 Takenaga ..... 4/420.4
7,191,473 B2 * 3/2007 Matsumoto et al. ..... 4/420.2
7,249,392 B1 * 7/2007 Paille ..... 15/210.1
7,316,038 B2 * 1/2008 Egeresi ..... 4/420.4
7,543,339 B1 * 6/2009 Harris ..... 4/445
8,060,953 B1 * 11/2011 Dorra ..... 4/233
8,359,676 B2 * 1/2013 Richard et al. ..... 4/223
8,776,278 B1 * 7/2014 Dorra ..... 4/233
2004/0237239 A1 * 12/2004 Savell ..... 15/210.1
2005/0246828 A1 * 11/2005 Shirai et al. ..... 4/420.4
2011/0030133 A1 * 2/2011 Morotomi et al. ..... 4/443
2011/0072572 A1 * 3/2011 Hashimoto et al. ..... 4/443
2011/0191951 A1 * 8/2011 Hashimoto et al. ..... 4/443

* cited by examiner

*Primary Examiner* — Lori Baker
(74) *Attorney, Agent, or Firm* — RG Patent Consulting, LLC; Rachel Gilboy

(57) ABSTRACT

A hygienic washing system for use with a washroom fixture having a hose and nozzle assembly. The a hose and nozzle assembly includes a hose comprising flexible-plastic tube having; a proximal end; and a distal end; a nozzle comprising rigid-plastic having a first end and a second end comprising a hooked-end; a controller for controlling flow of water through the hose and nozzle assembly; and attachers comprising at least one suction cup. The controller comprises adjustable wheeled buttons comprising a volume-control button, a temperature-control button, and an on/off actuation button. The on/off actuation button is manipulatable between an on condition and an off condition, the on condition permitting the flow of the water, the off condition not permitting the flow of the water. The device is useful for hygienically cleaning individuals after latrine use.

3 Claims, 5 Drawing Sheets

HYGIENIC WASHING SYSTEM FOR USE WITH A WASHROOM FIXTURE

CROSS-REFERENCE TO RELATED APPLICATION

The present application is related to and claims priority from prior provisional application Ser. No. 61/475,724, filed Apr. 15, 2011 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of hygienic cleaning means and more specifically relates to a hygienic washing system for use with a washroom fixture.

2. Description of the Related Art

Many households in modern society have running water and indoor washroom facilities. Sometimes, it can be difficult for individuals to cleanse themselves after they've used the latrine. This can lead to an overall feeling of uncleanliness and can lead to various diseases or infections. Also, when cleaning after using the restroom, it can be difficult for individuals to do so without hitting sensitive tissue areas, which can cause damage to the skin, or cause pain and bleeding. Many individuals simply do not properly clean themselves after using the restroom because the areas on their bodies are difficult to reach. It is desirable that a convenient and effective means for such cleaning be made available. Caregivers also need effective means for safely cleaning individuals who cannot clean themselves, due to cognitive or physical dysfunction, decreased attention to task or behavioral problems.

Various attempts have been made to solve the above-mentioned problems such as those found in U.S. Pat. Nos. 2004/0237239; 6,145,154; 6,272,716; 6,955,662; 7,249,392; D346,861; and D439,977. This prior art is representative of cleaning means. None of the above inventions and patents, taken either singly or in combination, is seen to describe the invention as claimed.

Ideally, a hygienic washing system should be convenient and user-friendly and, yet would operate reliably and be manufactured at a modest expense. Thus, a need exists for a reliable hygienic washing system for use with a washroom fixture to avoid the above-mentioned problems.

BRIEF SUMMARY OF THE INVENTION

In view of the foregoing disadvantages inherent in the known hygienic cleaning art, the present invention provides a novel hygienic washing system for use with a washroom fixture such as a toilet. The general purpose of the present invention, which will be described subsequently in greater detail is to provide hygienic cleaning means convenient for after the use of a latrine.

Hygiene toileting aid comprising hygienic washing system is a toileting device that can attach to the toilet (latrine) or bathroom sink and can be used by caregivers to cleanse elderly individuals or handicapped individuals, as well as individuals wanting to cleanse themselves, after they've used the restroom. This innovative product can be used for vaginal or rectal use and can allow individuals to cleanse themselves with fewer traumas to sensitive tissue and with less pain. When using this product, individuals can also control the water temperature and water pressure. Although ideal for virtually everyone, this product can be especially useful for caregivers that assist with toileting individuals with a decreased range of motion, elderly individuals, individuals with hemorrhoids, and handicapped individuals. Some individuals are unable to clean themselves due to obesity, injury of the back, shoulder or arm, which limits upper extremity range of motion. Some individuals have deformities that limit reach. This is an assistive device that will enable these people to clean themselves.

A hygienic washing system for use with a washroom fixture is disclosed herein in a preferred embodiment comprising a hose and nozzle assembly. The hose and nozzle assembly includes a hose comprising a flexible-plastic tube having a proximal end and a distal end. The nozzle comprises rigid-plastic having a first end and a second end comprising a hooked-end in preferred embodiments. The hooked-end permits a caregiver to strategically aim the water to wash-clean the body area (vagina or rectum) of the individual. The distal end of the hose is connected in communication with a pressurized water source having hot and cold water. The proximate end of the hose is coupled to the first end of the nozzle such that the water from the pressurized water source can pass through the hose and through the first end and the second end of the nozzle, when permitted by the controller, to provide the water upon demand to wash-clean a body area of an individual after use of the washroom fixture, the washroom fixture comprising a toilet. Pressure and heat are suitably controlled such that the individual is not hurt from use.

The hygienic washing system for use with a washroom fixture further comprises a controller for controlling flow of water through the hose and nozzle assembly and attachers comprising at least one suction cup such that it may be conveniently stored. The controller comprises adjustable wheeled buttons comprising at least a volume-control button, a temperature-control button, and an on/off actuation button. The volume-control button controls a volume of the flow of the water egressing from the second end of the nozzle. The temperature-control button is useful to control a relative temperature of the water egressing from the second end of the nozzle. The on/off actuation button is manipulatable between an on condition and an off condition, the on condition permitting the flow of the water, the off condition not permitting (restricting) the flow of the water.

A method for use of a hygienic washing system for use with a washroom fixture is also disclosed herein comprising the steps of: using a toilet; aiming a nozzle; activating a controller via moving an on/off actuation button to an on-position; cleaning a body area with pressurized water; and deactivating the on/off actuation button moving the on/off actuation button to an off-position. The method may further comprise the step of altering a temperature and or volume of the water.

The present invention holds significant improvements and serves as a hygienic washing system for use with a washroom fixture. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, hygienic washing system for use with a washroom fixture, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a cleaning device and more particularly to a hygienic washing system for use with a washroom fixture as used to improve the hygiene of individuals after use of a latrine.

Generally speaking, hygienic washing system (as a hygiene toileting aid) can enable individuals to cleanse their vagina or anus after using the restroom. This unique product can comprise a thin, round flexible hose-like device with a hard-plastic handle. The handle can have three knobs (buttons) on it to denote on/off, water pressure, and water temperature and can be connected to a longer hose, which can attach to the toilet or the sink. The nozzle used for cleansing can be slightly hooked, allowing the product to be used at a convenient angle. The entire device can attach to the side of the toilet via suction cups; the nozzle does not have suction cups. The suction cups attach to the toilet for easy storage and access. To use, individuals can simply select the desired water pressure and water temperature and cleanse themselves. This device is designed to be used while the patient is sitting on the toilet, leaning forward while the caregiver stands in front of the patient (or to the side) and reaches behind them and uses this device to clean patient. The product can also be used by a caregiver in a similar manner.

Figure 1:
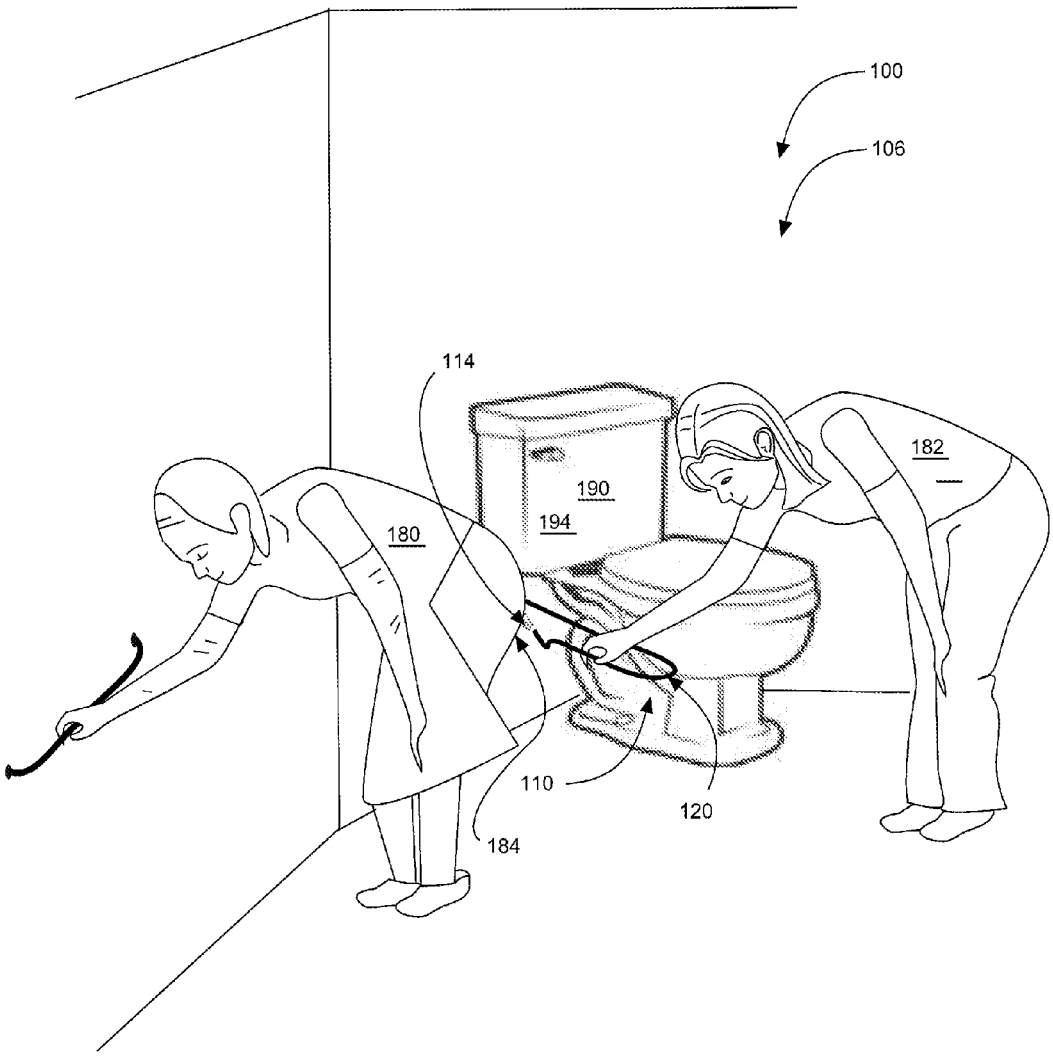
FIG. 1 shows a perspective view illustrating a hygienic washing system for use with a washroom fixture in an in-use condition according to an embodiment of the present invention.

Referring to the drawings by numerals of reference there is shown in FIG. 1, a perspective view illustrating hygienic washing system 100 for use with washroom fixture 190 in in-use condition 106 according to an embodiment of the present invention.

Hygienic washing system 100 for use with washroom fixture 190 preferably comprises: hose and nozzle assembly 110. Hose and nozzle assembly 110 preferably includes hose 120 having proximal end 130 and distal end 140. Further, hose and nozzle assembly 110 preferably includes nozzle 150 having first end 154 and second end 160, and controller 170 for controlling the flow of water 114 through hose and nozzle assembly 110.

Distal end 140 of hose 120 is preferably connected in communication with a pressurized water source 124. Proximate end 130 of hose 120 is coupled to first end 154 of nozzle 150 such that water 114 from pressurized water source 124 can pass through hose 120 and through first end 154 and second end 160 of nozzle 150, when permitted by controller 170, to provide water 114 upon demand to wash-clean body area 184 of individual 180 by caregiver 182 after use of washroom fixture 190, as shown. Body area 184 of individual 180 may comprise a rectum, vagina or the like and may be suitably cleaning via aiming and washing once volume and heat have been set, as described subsequently.

Caregiver 182 is shown to the side of individual 180 for ease of showing the various components; however it should be appreciated that in practice the preferred positioning is caregiver 182 being in front of individual 180; individual 180 in a nearly seated position, with head of individual 180 adjacent chest of caregiver 182, while caregiver 182 manipulates hose and nozzle assembly 110 around individual 180 to clean anus and/or vagina of individual 180. In this way water 114 is able to descend into toilet 194 to wash away and to minimize messy and/or slippery conditions. In this way the present invention serves to assist caregiver 182 with toileting hygiene and to clean the anus, vagina of elderly or handicapped individual(s) 180 with relative ease. This also serves to promote cleanliness in individuals 180 with decreased range of motion of arms, shoulders or back, individuals 180 with hemorrhoids, those who are obese, in pain, all with less trauma and more efficiently.

Figure 2:
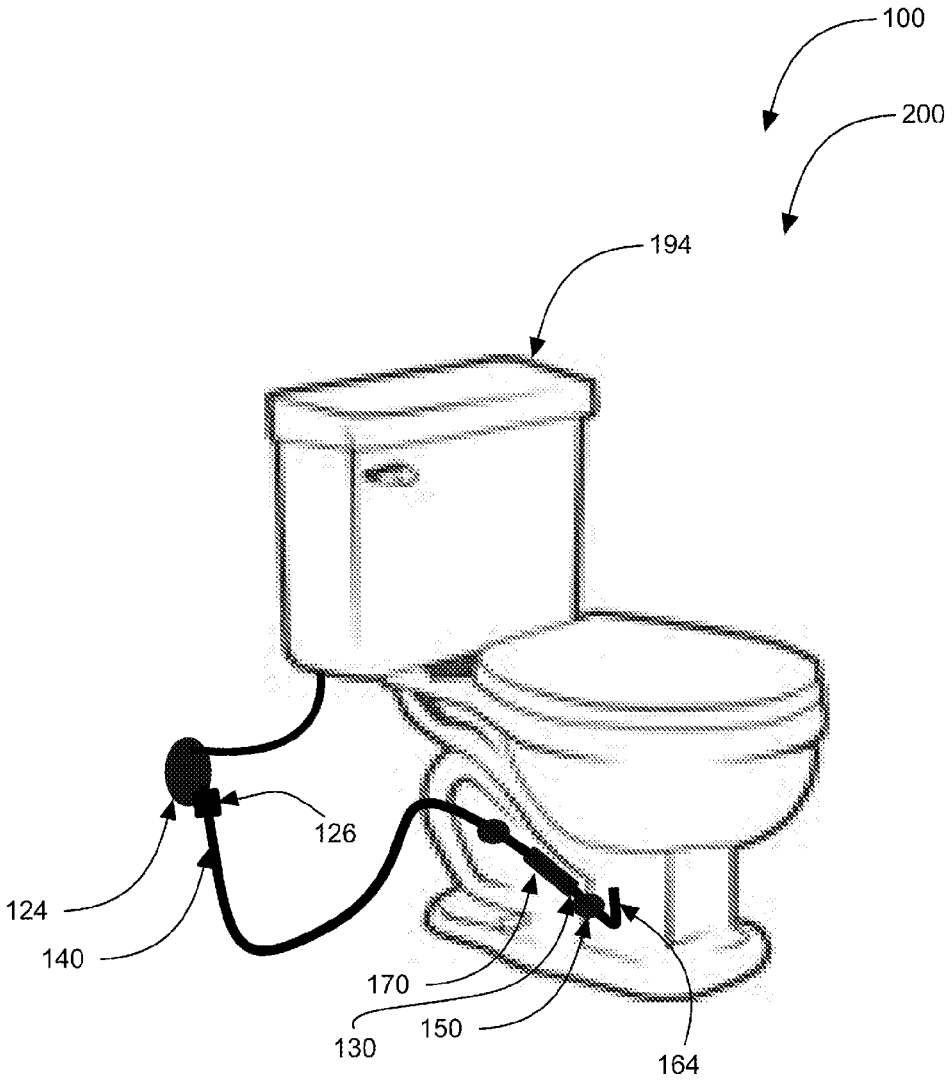
FIG. 2 is a perspective view illustrating the hygienic washing system in a non-use condition (stored) according to an embodiment of the present invention of FIG. 1.

Referring now to FIG. 2, a perspective view illustrating hygienic washing system 100 in non-use condition 200 according to an embodiment of the present invention of FIG. 1.

Washroom fixture 190 comprises toilet 194 in the present FIGS. 1 & 2; however may be hooked to sinks or other such fixtures. Hose and nozzle assembly 110 is connectable pressurized water source 124 via quick coupler 126. Those with ordinary skill in the art will now appreciate that upon reading this specification and by their understanding the art of plumbing of the present invention into existing systems as described herein, methods of plumbing, coupling to hot/cold water systems, valving, sealing and the like will be understood by those knowledgeable in such art. It should be noted that in certain alternate embodiments the present invention may be removable via quick coupler 126 which permits hose and nozzle assembly 110 to be readily removable from pressurized water source 124.

Non-use condition 200 comprises a stored condition wherein the present invention is readily accessible for use, yet does not provide an obstacle. Attachers such as suction cups may be used, as shown such that the device may be also attached at a different position/location for example if individual 180 is unable to stoop to reach it in the position shown. In this way the device may be attached to for example a tile wall or the like, making the device accessible to virtually anyone.

Figure 3:
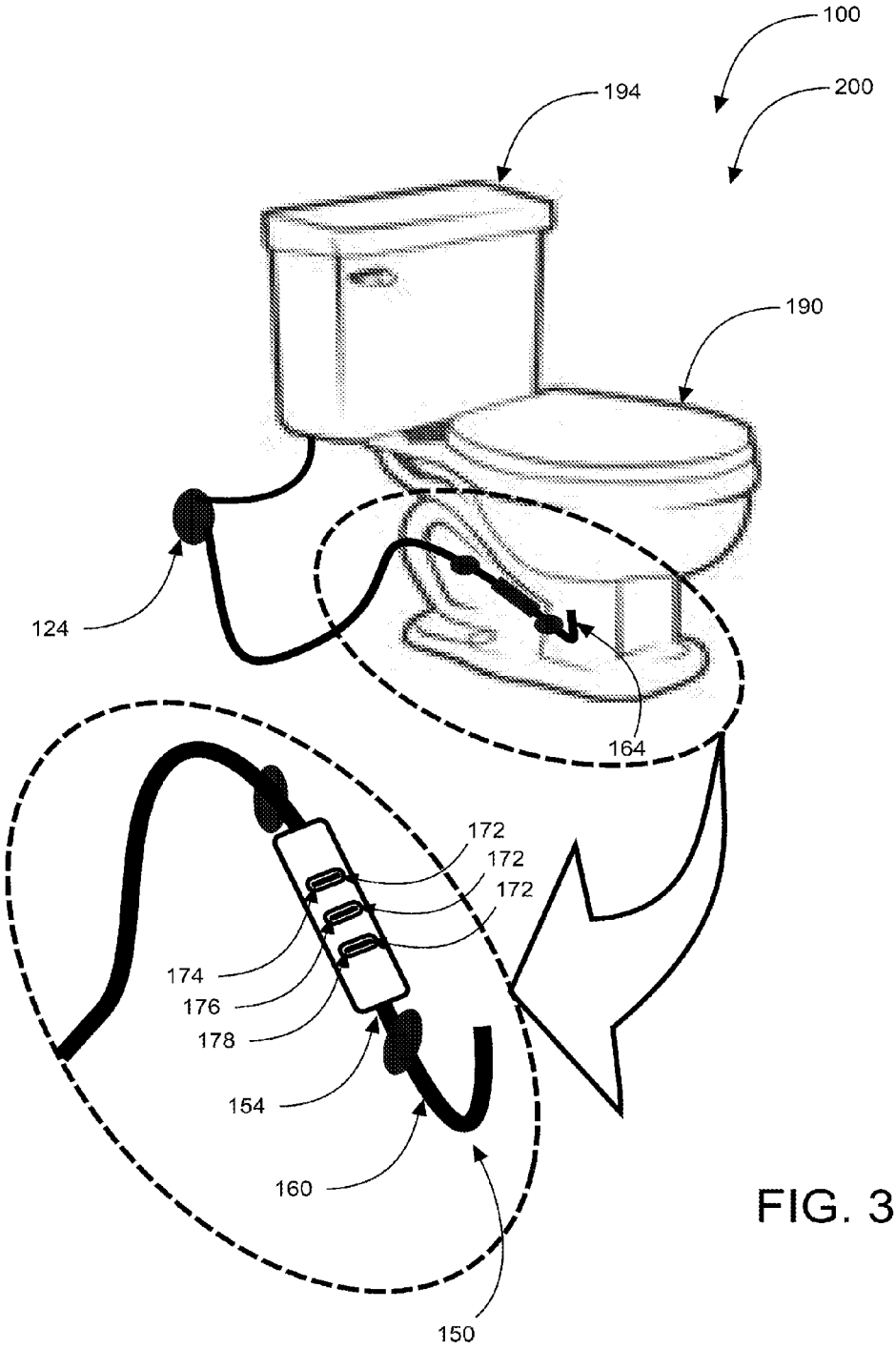
FIG. 3 is a perspective view illustrating a nozzle as attached to a hose forming a hose and nozzle assembly according to an embodiment of the present invention of FIG. 1.

Referring now to FIG. 3, a perspective view illustrating nozzle 150 as attached to hose 120 forming hose and nozzle assembly 110 according to an embodiment of the present invention of FIG. 1.

Second end 160 of nozzle 150 preferably comprises hooked-end 164 in preferred embodiments. Hooked-end 164 preferably permits individual 180 such as caregiver 182 to strategically aim water 114 to wash-clean body area 184 of individual 180, as alluded to in FIG. 1. This particular feature may improve safety and also improve cleaning through improved control.

Nozzle 150 preferably comprises rigid-plastic. Upon reading this specification, it should be appreciated that, under appropriate circumstances, considering such issues as user preferences, design preference, structural requirements, marketing preferences, cost, available materials, technological advances, etc., other rigid material arrangements such as, for example, stainless steel, ceramic, etc., may be sufficient.

Hose 120 preferably comprises flexible-plastic such that it is reasonably piable and inexpensive to manufacture. Flexible-plastic is also used to avoid corrosion. Upon reading this specification, it should be appreciated that, under appropriate circumstances, considering such issues as user preferences, design preference, structural requirements, marketing preferences, cost, available materials, technological advances, etc., other material arrangements for hose such as, for example, a flexible stainless steel conduit, etc., may be sufficient.

Figure 4:
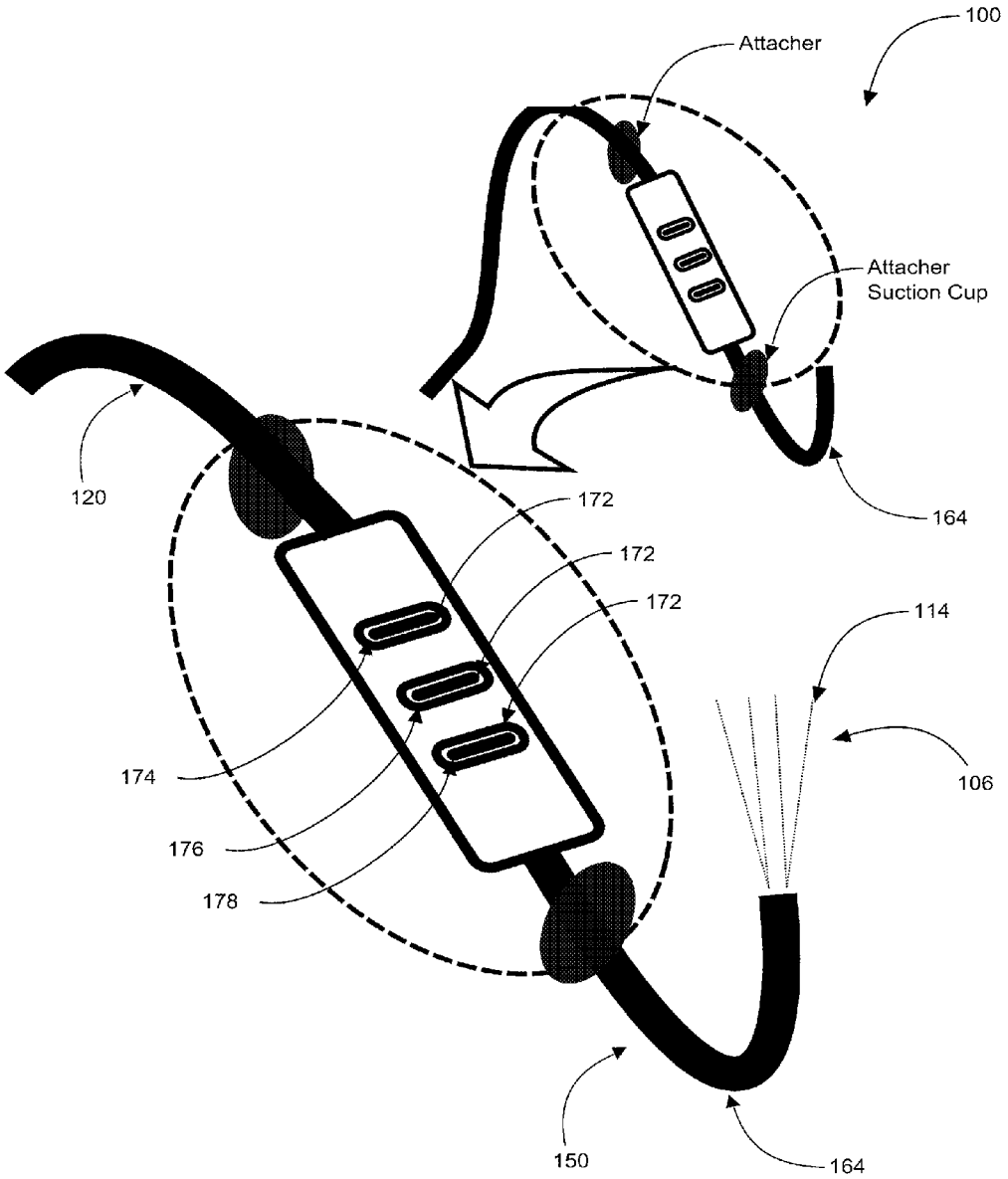
FIG. 4 is a perspective view illustrating a controller comprising adjustable wheeled buttons including a volume-control button, a temperature-control button, and an on/off actuation button according to an embodiment of the present invention of FIG. 1.

Referring now to FIG. 4, a perspective view illustrating controller 170 comprising adjustable wheeled buttons 172 including volume-control button 174, temperature-control button 176, and on/off actuation button 178 according to an embodiment of the present invention of FIG. 1.

Controller 170 preferably comprises adjustable wheeled buttons 172 including volume-control button 174, temperature-control button 176, and on/off actuation button 178. Volume-control button 174 controls a volume of the flow of water 114 egressing from second end 160 of nozzle 150. Temperature-control button 176 is useful to control a relative temperature of the water egressing from second end 160 of nozzle 150. On/off actuation button 178 is (rollably or otherwise) manipulatable between an on condition and an off condition, with the on condition permitting the flow of water 114, while the off condition does not permit the flow of water 114.

Hygienic washing system 100 for use with a washroom fixture 190 further comprising attacher 400. Attacher 400 preferably comprises at least one suction cup, as alluded to in FIG. 2. Upon reading this specification, it should be appreciated that, under appropriate circumstances, considering such issues as user preferences, design preference, structural requirements, marketing preferences, cost, available materials, technological advances, etc., other attacher arrangements such as, for example, clips, hooks, hook and loop fasteners, etc., may be sufficient. Suction cups attach to the toilet. The suction cups preferably have clips that allow for the nozzle to slid into for easy storage and access for use, as shown in the upper right side of FIG. 4. High quality suction cups that will adhere to porcelain are preferably used. Arrows indicating direction for clipping of suction cups and clips is shown.

Figure 5:
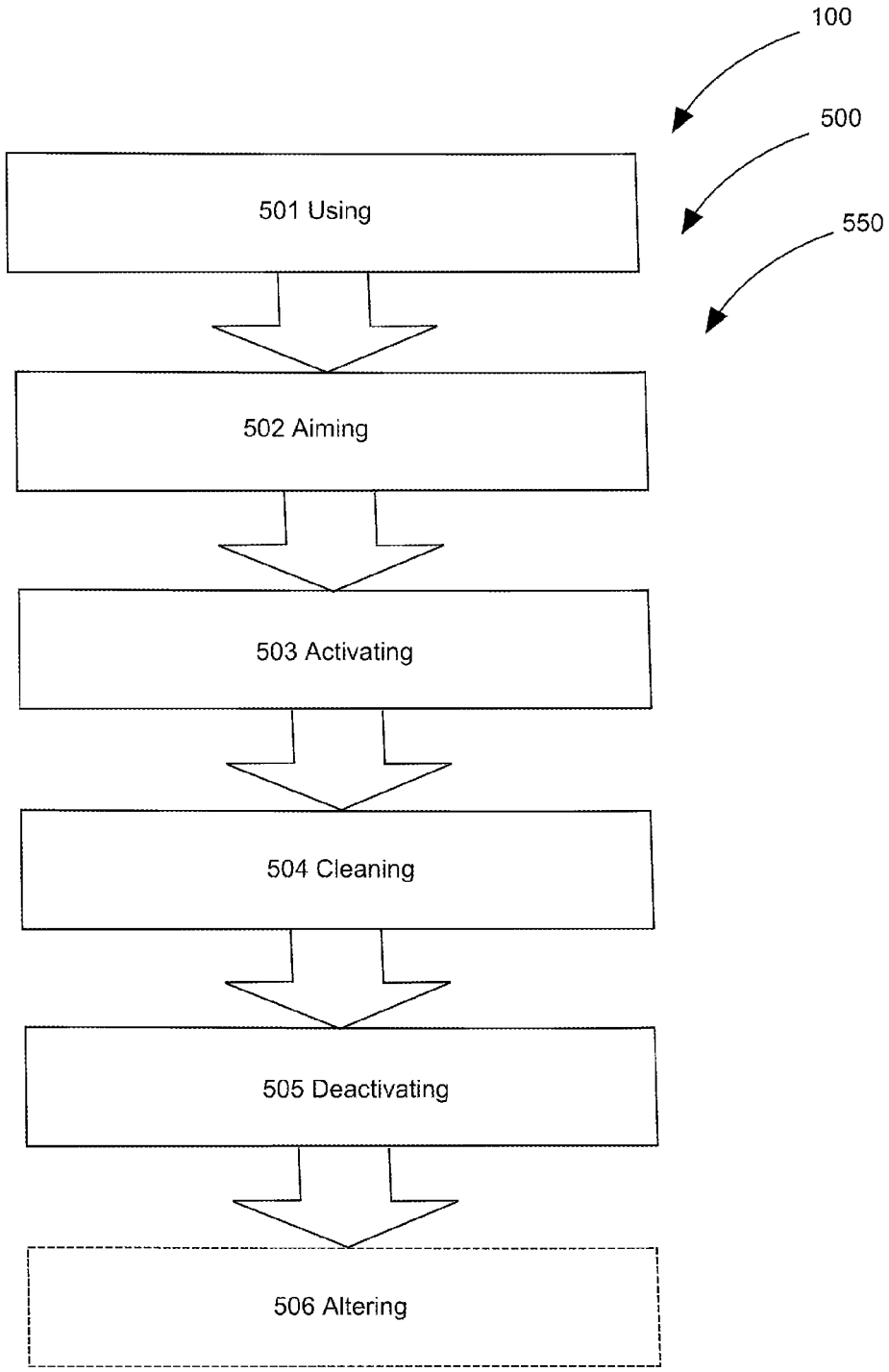
FIG. 5 is a flowchart illustrating a method of use for the hygienic washing system for use with a washroom fixture according to an embodiment of the present invention of FIGS. 1-4.

Referring now to FIG. 5, a flowchart 550 illustrating a method of use for hygienic washing system 100 for use with washroom fixture 190 according to an embodiment of the present invention of FIGS. 1-4.

A method for use of hygienic washing system 100 for use with washroom fixture 190 comprises the steps of: step one 501 using toilet 194; step two 502 aiming nozzle 150; step three 503 activating controller 170 via moving on/off actuation button 178 to an on-position; step four 504 cleaning body area 184 with pressurized water 114; step five 505 deactivating on/off actuation button 160, moving on/off actuation button 178 to an off-position; and step six 506 altering a temperature of water 114. Altering pressure may also comprise a further step if desired.

It should be noted that step 506 is an optional step and may not be implemented in all cases. Optional steps of method 500 are illustrated using dotted lines in FIG. 5 so as to distinguish them from the other steps of method 500.

It should be noted that the steps described in the method of use can be carried out in many different orders according to user preference. The use of "step of" should not be interpreted as "step for", in the claims herein and is not intended to invoke the provisions of 35 U.S.C. §112, ¶ 6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A hygienic washing system for use with a washroom fixture comprising:

a) a hose and nozzle assembly including;
  i) a hose comprising flexible-plastic tube having;
    (1) a proximal end; and
    (2) a distal end;
  ii) a nozzle comprising rigid-plastic having;
    (1) a first end; and
    (2) a second end comprising a hooked-end;

b) a controller for controlling flow of water through said hose and nozzle assembly; and attachers comprising at least one suction cup;

c) wherein said controller comprises adjustable wheeled buttons comprising at least a volume-control button, a temperature-control button, and an on/off actuation button;

d) wherein said volume-control button controls a volume of said flow of said water egressing from said second end of said nozzle;

e) wherein said temperature-control button is useful to control a relative temperature of said water egressing from said second end of said nozzle;

f) wherein said on/off actuation button is manipulatable between an on condition and an off condition, said on condition permitting said flow of said water, said off condition not permitting said flow of said water;

g) wherein said hooked-end permits a caregiver to strategically aim said water to wash-clean said body area of said individual;

h) wherein said distal end of said hose is connected in communication with a pressurized water source having hot and cold said water; and i) wherein said proximate end of said hose is coupled to said first end of said nozzle such that said water from said pressurized water source can pass through said hose and through said first end and said second end of said nozzle, when permitted by said controller, to provide said water upon demand to wash-clean a body area of an individual after use of said washroom fixture, said washroom fixture comprising a toilet.

2. A method for use of a hygienic washing system of claim 1 for use with a washroom fixture comprising the steps of:

a) using a toilet;

b) aiming a nozzle;

c) activating a controller via moving an on/off actuation button to an on-position;

d) cleaning a body area with pressurized water; and e) deactivating said on/off actuation button moving said on/off actuation button to an off-position.

3. The method of claim 2 further comprising the step of altering a temperature of said water.

* * * * *